United States Patent [19]

Franks

[11] Patent Number: 4,847,989

[45] Date of Patent: Jul. 18, 1989

[54] SPIRAL EXPANDING BULLET

[75] Inventor: Lawrence A. Franks, Sturgis, Mich.

[73] Assignee: Burr Oak Tool & Gauge Company, Sturgis, Mich.

[21] Appl. No.: 504,926

[22] Filed: Jun. 16, 1983

[51] Int. Cl.[4] ..... B23P 15/26

[52] U.S. Cl. ..... 29/727; 72/283

[58] Field of Search ..... 29/157.3 A, 157.3 B, 29/726, 727, 157.3 C; 72/112, 114, 283, 479

[56] References Cited

U.S. PATENT DOCUMENTS

| | | | |
|---|---|---|---|
| 2,852,835 | 9/1958 | Harvey et al. . | |
| 3,504,513 | 4/1970 | Black . | |
| 3,830,087 | 8/1974 | Nakamura et al. . | |
| 4,057,992 | 11/1977 | Wiilimzik . | |
| 4,175,416 | 11/1979 | Fukushima et al. | 29/157.3 A |
| 4,300,275 | 11/1981 | McLaughlin . | |

FOREIGN PATENT DOCUMENTS

| | | | |
|---|---|---|---|
| 551988 | 1/1923 | France | 29/157.3 A |
| 149737 | 11/1980 | Japan | 29/157.3 B |
| 17085 | of 1898 | United Kingdom | 29/157.3 A |
| 916650 | 1/1963 | United Kingdom | 29/157.3 A |

*Primary Examiner*—Joseph M. Gorski

*Attorney, Agent, or Firm*—Flynn, Thiel, Boutell & Tanis

[57] ABSTRACT

An apparatus and process for forming heat-transfer elements wherein platelike fins are secured to the outside wall of a heat-transfer tube. There is provided a bullet-shaped tool which is axially slidably inserted into the heat-transfer tube to effect radial expansion thereof into gripping engagement with the surrounding fins. The tool is freely rotatably supported on the end of a pushing rod, and the peripheral surface of the tool has spiral grooves therein which define small teeth therebetween. By axially pushing the tool into the tube, the teeth bite into the internal wall of the tube and, due to the helical orientation of these teeth, the axial displacement of the tool into the tube causes the tool to simultaneously rotate. This causes not only radial expansion of the tube for gripping the fins, but simultaneously results in the formation of spiral-like grooves on the internal wall of the tube.

3 Claims, 2 Drawing Sheets

SPIRAL EXPANDING BULLET

FIELD OF THE INVENTION

This invention relates to a bullet-like tool which is adapted to be axially pushed into or pulled through a heat exchanger tube for expanding same to effect mounting of heat-transfer fins thereon. More particularly, the invention relates to an improved expanding tool which has spiral grooves on the exterior thereof so that the tool rotates as it moves axially through the tube and spiral grooving is formed in the interior surface of the tube whereby to increase the surface area of the internal surface of the tube and increase the turbulence of heat-transfer medium flowing therethrough and hence increase the heat-transfer characteristics.

BACKGROUND OF THE INVENTION

It is well known to insert a bullet-like tool or mandrel into a heat-transfer tube and then displace the tool axially with respect to the tube so as to effect radial expansion of the tube into gripping engagement with surrounding heat-transfer fins. However, in the forming of such heat-transfer members, namely, heat-transfer tubes having radially extending fins thereon, the bullet-like tool is conventionally fixedly secured to a pushing or pulling element and effects solely a radial expansion of the tube because the tool has a diameter slightly greater than the normal interior diameter of the tube. While this forming apparatus and process are satisfactory, nevertheless there is a continuing desire to improve the performance or heat-transfer characteristics of heat-transfer elements formed in this way. The apparatus and process of this invention are effective to significantly improve such heat-transfer characteristics.

Accordingly, it is an object of this invention to provide an improved apparatus and process for forming heat-transfer elements wherein platelike fins are secured to the outside wall of a heat-transfer tube. In the improved process and apparatus of this invention, there is provided a bullet-shaped tool or mandrel which is axially slidably inserted into the heat-transfer tube to effect radial expansion thereof into gripping engagement with the surrounding platelike fins. In a preferred embodiment of the invention, the tool is freely rotatably supported on the end of a suitable pushing or pulling rod, and the peripheral surface of the tool has a large number of small grooves extending axially therealong, which grooves are also skewed relative to the axial direction, that is, provided with a helixed or spiral orientation. These grooves hence define a large number of small teeth on the periphery of the tool, and the outer diameter of these teeth is slightly greater than the internal diameter of the tube. By axially pushing or pulling the tool into the tube, the teeth bite into the internal wall of the tube and, due to the helical orientation of these teeth, the axial displacement of the tool into the tube causes the tool to simultaneously rotate. This causes not only radial expansion of the tube for gripping the fins, but simultaneously results in the formation of spiral-like grooves on the internal wall of the tube. These grooves increase the surface area of the internal surface of the tube and increase the turbulence of the heat-transfer liquid, and thus increase the heat-transfer characteristic of the finned tube.

While a spirally grooved tool or mandrel movable internally of a workpiece is already known, as evidenced by U.S. Pat. No. 4,300,275 (McLaughlin), nevertheless this known tool is utilized for forming a wholly different type of structure, and the tool possesses a mounting structure which is less than desirable when one wishes to repetitively form large numbers of heat-transfer tubes, as in the present invention.

Hence, the present invention provides an improved bullet-like tool having grooves on the periphery thereof, with the tool having an improved mounting arrangement which facilitates the rotatable mounting of the tool on the free end of the pushing or pulling rod so as to enable it to possess substantial durability and at the same time withstand the substantial forces and the working conditions to which it is exposed.

The present invention also relates to an improved process for forming finned heat-exchanger tubes using the improved tool described above, which process permits the turbulence-causing spiral grooves to be formed on the internal wall thereof simultaneously with effecting the radial expansion of the tube into engagement with the surrounding fins, whereby the overall finned heat-exchanger tube can hence be formed in a single operation.

Other objects and purposes of the invention will be apparent to persons familiar with apparatus and processes of this general type, after reading the following specification and inspecting the accompanying drawings.

Figure 1:
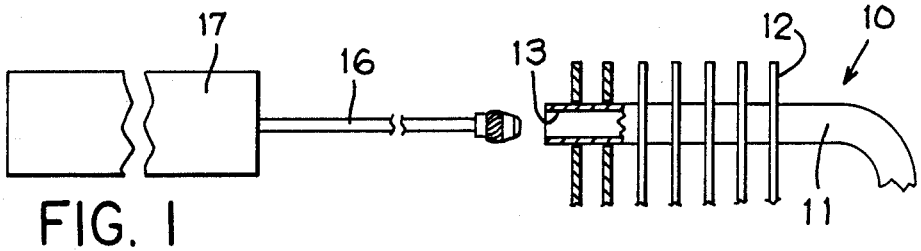
FIG. 1 diagrammatically illustrates the process and apparatus of this invention.

Certain terminology will be used in the following description for convenience in reference only and will not be limiting. For example, the words "upwardly", "downwardly", "rightwardly" and "leftwardly" will refer to directions in the drawings to which reference is made. The words "forwardly" or "inwardly" will be used to refer to the direction of insertion of the tool into the tube, and the words "rearwardly" and "outwardly" will refer to the withdrawal direction. The words "inwardly" and "outwardly" will also refer to directions toward and away from, respectively, the geometric center of the apparatus and designated parts thereof. Said terminology will include the words specifically mentioned, derivatives thereof, and words of similar import.

DETAILED DESCRIPTION

Referring to FIG. 1, there is illustrated a conventional heat exchanger element 10 (often referred to as a finned tube) which includes a tube 11, normally made of copper, having a plurality of thin platelike fins 12 (normally made of aluminum) fixed to the external wall of the tube so that the fins project radially therefrom to increase the heat-transfer characteristics. The heat-transfer element 10 is conventionally formed by initially sliding the fins 12 over the tube 11, prepositioning the fins relative to the tube, and then axially sliding a mandrel or tool into the bore 13 of the tube 11 so as to effect radial expansion thereof of sufficient magnitude to effect a secure connection between the tube and the fins. Although FIG. 1 illustrates a conventional U-shaped heat exchanger element, it will be appreciated that the present invention is equally applicable for forming straight heat exchanger elements. In the known process and apparatus, the tool is normally fixedly and non-rotatably mounted adjacent the free end of an elongated pushing rod 16 which is secured to a suitable reciprocal power source 17, such as a double-acting fluid pressure cylinder.

Figure 2:
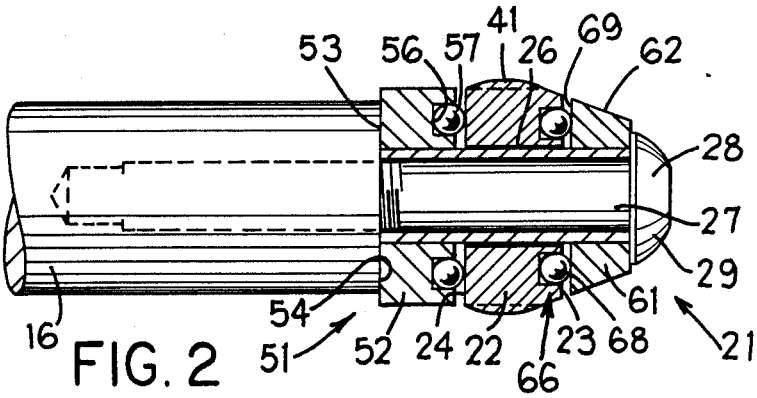
FIG. 2 is a fragmentary enlarged view, partially in cross section, illustrating the pusher having the bullet-like forming tool mounted thereon.

Considering now the improved apparatus of this invention, and referring to FIG. 2, there is illustrated an improved bullet-like tool assembly 21 mounted on the free end of the push rod 16. This tool assembly 21 includes a rotatable sleeve member 22 which defines the expanding mandrel 22 (hereinafter referred to as the "bullet"). This bullet 22 has front and rear surfaces 23 and 24, respectively, formed at opposite axial ends thereof, which surfaces are substantially perpendicular to the central longitudinal axis of the bullet. This bullet 22 surrounds and is rotatably supported on a suitable bearing 26 formed as an elongated cylindrical bushing, the latter in turn being disposed in surrounding relationship to the shank 27 of a threaded fastener 28 which is coaxially threaded into the free end of the push rod 16.

Figure 3:
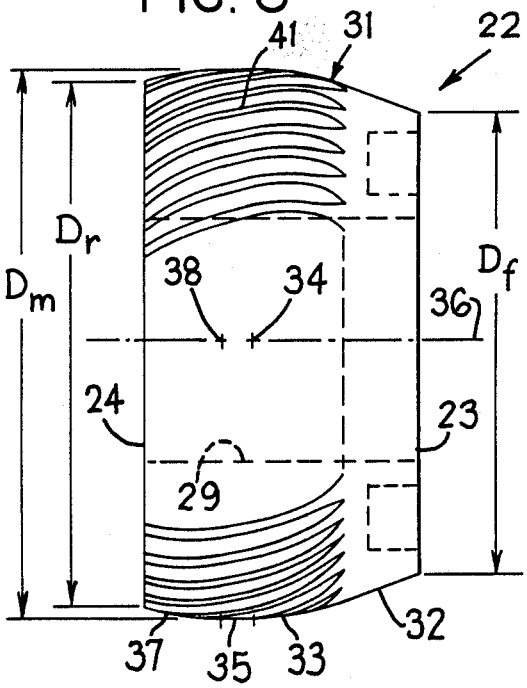
FIG. 3 is a plan view of the rotatable bullet, by itself.
Figure 4:
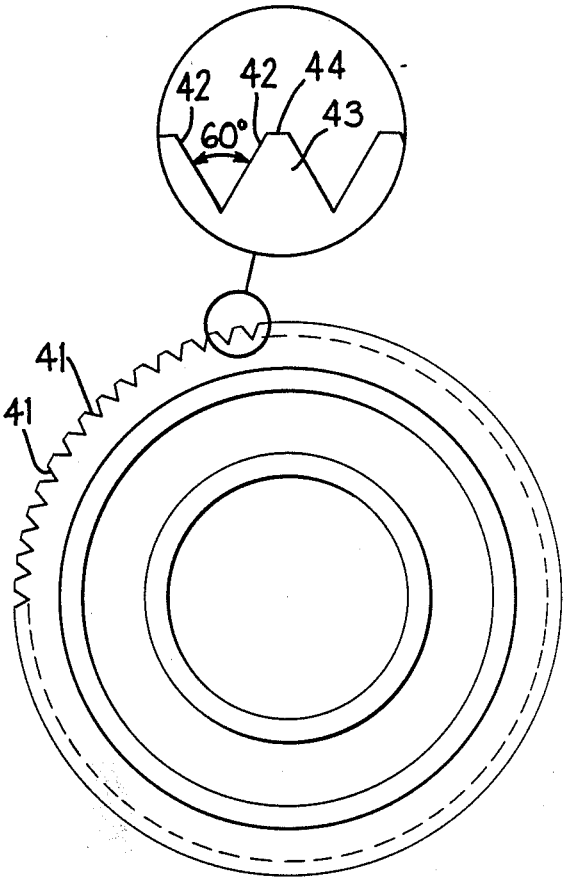
FIG. 4 is an end view of the bullet.

The bullet 22 has an exterior peripheral surface 31 which, as viewed in axial cross section, is of generally tapered configuration. As illustrated by FIG. 3, the annular exterior surface 31 includes a cylindrical tapered surface 32 which diverges radially outwardly as it extends axially rearwardly from the front axial face 23. This tapered surface 32 at its rearward end merges with an intermediate axially curved surface 33 which is effectively generated on a radius about a center point 34 which is located on the central rotational axis 36 of the bullet. A further axially curved surface 37 extends forwardly from the rear surface 24. The curved surface is generated on a radius about a center point 38. The radius that generates surface 37 is equal to the radius that generates surface 33. The center point 38 is coaxial with center point 34 and is spaced rearwardly therefrom. The adjacent ends of surfaces 33 and 37 are connected by a straight surface 35 which is parallel with the rotational axis 36. The radial distance between axis 36 and surface 35 is the same as the radius of curved surfaces 33 and 37. The axial length of surface 35 is the same as the axial distance between center points 34 and 38. The surface 35 defines the maximum diameter of the bullet. The front end of the tapered surface 32 defines a minimum diameter $D_f$ at the front end of the bullet which is smaller, preferably slightly smaller, than the diameter of the tube bore 13. The straight surface 35 defines the maximum diameter $D_m$ of the bullet, which diameter is slightly greater than the diameter of the bore 13. The rear surface 37 defines a diameter $D_r$ which is also preferably slightly less than the diameter of bore 13 so as to facilitate the withdrawal of the bullet from the tube.

The exterior surface 31 of bullet 22 has a plurality of grooves 41 formed therein, which grooves extend axially of the surface from the rear end face 24 partway to the front end face 23. The front ends of the grooves 41 start at or slightly in front of the location at which the external diameter of the bullet is equal to the internal diameter of the tube 13. Thus, the front end portion of the surface 32 is free of grooves 41. The number of grooves 41 can be in the range of from about 20 to about 50 grooves, per inch of the circumference of the bullet at the straight surface 35. The grooves 41 are inclined relative to an axial plane, that is, the grooves are generated along a spiral or helical path which preferably defines an angle in the range of 7° to 30° relative to an axial plane. These grooves 41 are preferably V-shaped such that the opposed intersecting side walls 42 thereof define an included angle therebetween of from about 60° to about 90°. The adjacent grooves 41 form narrow teeth 43 therebetween, which teeth have a substantially flat top surface 44, which surface 44 is very narrow when viewed circumferentially, such as approximately 0.005 inch. The grooves 41 are provided uniformly around the periphery of the bullet, preferably in angularly close proximity with one another. For expanding copper tubing having an outside diameter of 0.375 inches and a wall thickness of 0.014 to 0.016 inches, the grooves 41 preferably have a radial depth of about 0.010 inch to about 0.012 inch.

To facilitate free rotation of bullet 22 when it is subjected to substantial axial thrust forces imposed rearwardly thereon, the tool assembly 21 also includes a rear bearing means 51 which is provided primarily to function as an axial thrust bearing to facilitate free rotation of the bullet 22. This rear thrust bearing 51 includes a rear bearing cap or race 52 formed as a sleevelike member disposed in close fitting surrounding relationship to the bushing 26. This bearing race has the rear surface 53 thereof normally abutted against the front end surface 54 of the push rod 16, whereby the bearing race 52 normally remains in a nonrotatable condition. This bearing race defines an annular groove 56 in the front face thereof, which annular groove 56 opens axially forwardly and confines a plurality of conventional bearing balls 57 therein, which balls hence rollingly contact the rear planar surface 24 of the bullet. The rear bearing race 52 has an outside diameter which generally is substantially equal to the rear diameter $D_r$ of the bullet.

The front end of the tool means 21 is provided with a guide 61 thereon, the latter being a sleeve member which is snugly disposed in surrounding relationship to the bushing 26 directly adjacent the front end of the bullet 22. This guide 61 has a tapered cylindrical exterior surface 62 which functions as a guide surface in that it diverges radially outwardly as it extends axially rearwardly. This tapered surface 62 preferably has the same taper as the front bullet surface 32, normally a 20° taper, and the rear or larger diameter end of this tapered guide surface 62 normally has a diameter which is substantially equal to but generally slightly smaller in diameter than the front diameter $D_f$ such that the guide surface 62 and front tapered surface 33 hence effectively define a continuous cylindrical tapered profile.

A front thrust bearing 66 cooperates between the guide 61 and the bullet 22. For this purpose, the bullet 22 has an annular groove 67 formed in the front face 23 thereof, which groove 67 also opens axially forwardly in the same direction as the groove associated with the rear thrust bearing. A plurality of conventional bearing balls 68 are confined within the groove 67 and disposed for rolling bearing engagement with the rear planar surface 69 formed on the guide 61.

The threaded fastener 27 has a rounded head 29 thereon which is positioned forwardly of and radially overlaps the guide 61 so as to coaxially and properly hold the guide 61, bullet 22 and bearing cap 52 in alignment with the rod 16 and properly positioned against the front end surface thereof. A suitable friction washer is preferably provided between the head 29 and the guide 61 so as to assist in holding the guide in a nonrotatable condition.

OPERATION

The process and operation of the invention will be briefly described to ensure a complete understanding thereof.

The tube 11 is normally fixedly positioned in a suitable fixture or holding device, often a tube bending apparatus, and the fins 12 are approximately positioned therealong. With the tool assembly 21 aligned with the open end of the bore 13, pressure cylinder 17 is energized such that push rod 16 is extended forwardly so as to move the tool assembly 21 into the bore 13. As the tool assembly 21 moves into the open end of the bore 13, the wall of the bore initially engages the peripheral surface 31 of the bullet, which initial engagement occurs substantially at that region of the bullet at which the spiral grooves 41 start. Hence, continued axial movement of the bullet 21 relative to tube 13 not only initiates outward radial expansion of the tube 11, but also causes the teeth defined between the spiral grooves 41 to bite into the inner wall of the tube and, due to the spiral orientation of the grooves, cause the bullet 22 to rotate relative to the push rod as the latter continues to push the bullet axially into the tube. This causes scoring of the internal wall of the tube, by forming substantially spiral grooving in said internal wall. Further, since the tube is also being simultaneously radially expanded such that the tube is moved into tight gripping engagement with the fins 12, which fins tend to impose a radial compression on the outer wall of the tube, this is believed to create more pronounced grooves on the interior wall of the tube.

In this improved process using the apparatus of this invention, by a single axial movement of the tool through the bore of the tube, the tool is caused to rotate simultaneously with the axial displacement thereof so that the tube is simultaneously both radially expanded and internally spirally grooved. During the withdrawal stroke, the teeth on the tool merely follow the already formed grooves on the internal wall of the tube, whereby the tool will again freely rotate in the reverse direction as the tool is axially withdrawn from the tube.

During the insertion of the tool into the tube, the presence of the bearings 51 and 61, both of which involve a plurality of bearing balls confined within grooves which both are directed in the front axial direction, permits the rearwardly directed axial thrust forces imnposed on the tool to be readily transmitted rearwardly into and through the push rod 16, while at the same time ensuring free and unrestricted rotation of the bullet 22. Further, since the bullet 22 has the internal bore 29 thereof slightly oversized in relationship to the bushing 26, the bullet can freely radially float relative to the bushing a limited amount so as to effecively self-center itself within the tube 11, irrespective of any possible slight misalignment between the tube and the push rod 16, and the front and rear thrust bearings readily permit this limited radial floating of the bullet.

MODIFICATIONS

Figure 5:
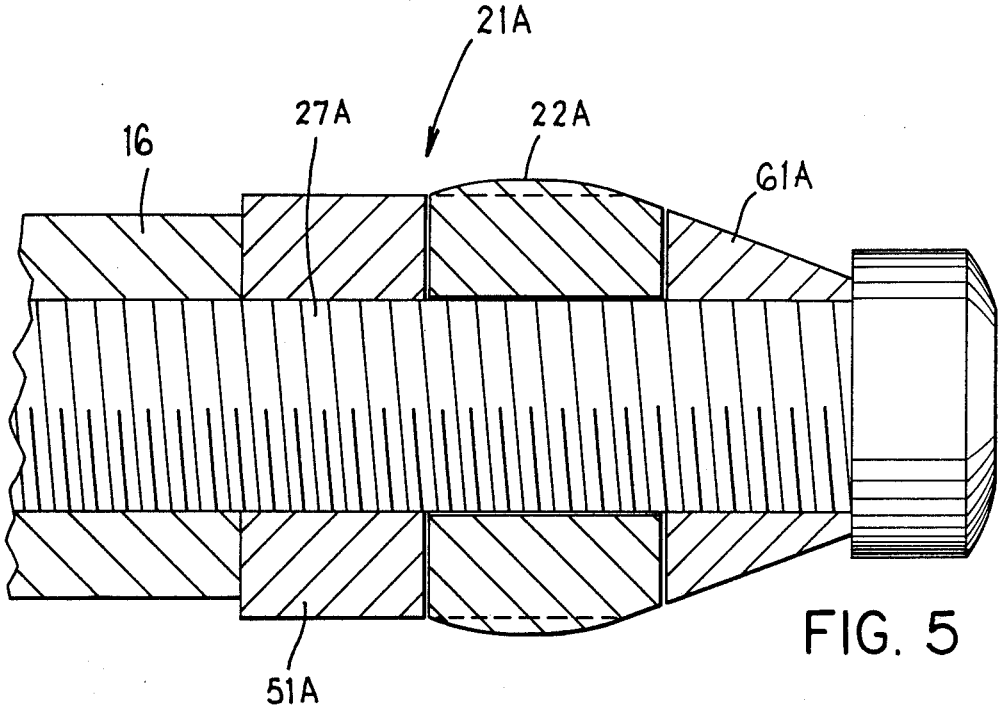
FIG. 5 is a sectional view of a first modification of the invention.

In another preferred embodiment of the invention, as illustrated in FIG. 5, the tool assembly 21A comprises a sleeve member or bullet 22A which encircles and is rotatably supported on a threaded fastener 27A. The rear bearing cap 51A and the front bearing cap 61A are internally threaded and are threaded on the fastener 27A so that they will not rotate with respect to said fastener. The bullet 22A is positioned freely between the caps 51A and 61A and encircles the fastener 27A so that the bullet 22A is free to rotate around said fastener. The construction of the bullet 22A and the operation of this embodiment are the same as in the previously described embodiment.

This embodiment is simplified in comparison with the embodiment of FIGS. 1 to 4 because the bushing 26, the two sets of bearing balls 57 and 68 and the associated grooves are omitted. The embodiment of FIG. 5 is highly satisfactory for most uses, although in some instances, particularly operations that involve high axial thrust loads on the tool assembly, the embodiment of FIGS. 1 to 4 may be preferred.

Figure 6:
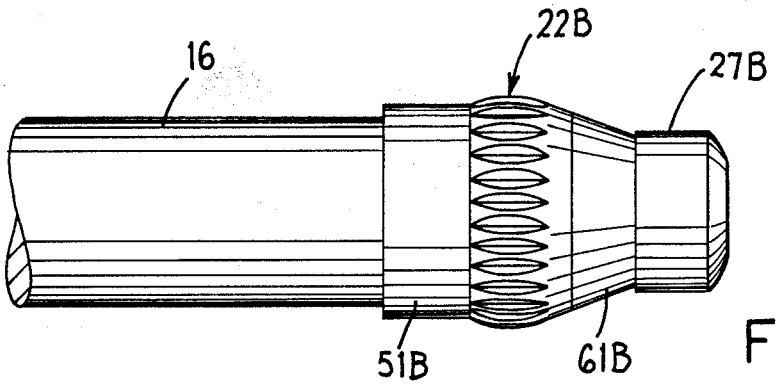
FIG. 6 is a plan view of a second modification of the invention.

FIG. 6 illustrates a third embodiment of the invention which is capable of meeting some, but not all, of the objects of the invention. In this embodiment, the bullet 22B is fixed in a non-rotatable condition on the fastener 27B, between the fixed end caps 51B and 61B. The grooves 41B are straight and extend axially. Thus, the bullet 22B does not rotate as it is moved through the tube 13, but rather, moves only axially through the tube. The grooves 41B are thus effective to form straight, axially extending grooves in the internal surface of the tube at the same time that the tube is expanded, as previously described.

Although the use of a rotatable bullet is preferred because of ease of operation and because it forms spiral grooving on the internal wall of tube 13 which increases surface area and turbulence, in some instances the apparatus of FIG. 6 is satisfactory for forming heat-exchange structures having improved characteristics.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A mandrel assembly for simultaneously radially outwardly expanding a heat exchanger tube and forming spiral grooving on the internal wall of said tube, comprising:

an elongated rod which is linearly reciprocable in its longitudinal direction, said rod having a coaxial shank of reduced diameter projecting forwardly from the front end of said rod, said shank having a smaller diameter than said rod so that a radially extending, annular, first surface is provided at the front end of said rod, said shank having a radially enlarged head at the front end thereof, said head having a radially extending, annular, second surface opposed to and axially spaced from said first surface;

a substantially annular bullet rotatably sleeved on said shank and disposed between said first and second surfaces, said bullet having a radially extending third, annular, surface opposed to and axially spaced from said first surface and having a radially extending, annular, fourth surface opposed to and axially spaced from said second surface, said bullet being freely rotatable with respect to said rod and said shank;

a cylindrical rear thrust bearing member mounted on said shank between said rod and said bullet, said rear thrust bearing member having radially extending annular front and rear walls at the opposite axial ends thereof which walls are opposed to said first and third surfaces, respectively, said rear wall of said rear thrust bearing member abutting against said first surface;

an annular front thrust bearing member mounted on said shank between said bullet and said head, said front thrust bearing member having radially extending, annular, front and rear walls at the opposite axial ends thereof which walls are opposed to said second and fourth surfaces, respectively, said front wall of said front thrust bearing member abutting against said second surface;

said bullet having an axially extending, frontward, exterior, surface portion which diverges radially outwardly in an axially rearward direction, said frontward exterior surface portion merging smoothly at its rear end with an intermediate, axially curved, exterior surface portion which diverges radially outwardly in a rearward direction, said intermediate exterior surface portion merging smoothly at its rear end with a middle, straight, exterior surface portion of uniform diameter, said middle straight portion merging smoothly at its rear end with a rearward, axially curved, exterior surface portion which converges radially inwardly in the rearward direction, said frontward exterior surface portion being smooth and said intermediate, middle and rearward exterior surface portions having a multitude of circumferentially spaced-apart, axially extending grooves of small depth formed therein and defining axially extending narrow teeth therebetween;

the exterior surface of said front thrust bearing member diverging radially outwardly in a rearward direction and the rearward end thereof being of substantially the same diameter as the frontward end of said frontward exterior surface portion of said bullet so that said exterior surface of said front thrust bearing member constitutes an extension of said frontward exterior surface portion of said bullet;

the frontward end of the exterior surface of said rear thrust bearing member being of substantially the same diameter as the rearward end of said rearward exterior surface portion of said bullet, said rear thrust bearing member being of smaller diameter than said middle portion of said bullet;

said third surface of said bullet and the opposing front wall of rear thrust bearing member being of substantially the same diameter and being closely axially spaced from each other and said fourth surface of said bullet and the opposing rear wall of said front thrust bearing being of substantially the same diameter and being closely axially spaced from each other whereby said bullet is closely confined between said front and rear thrust bearing members and is capable of free rotation with respect thereto.

2. A mandrel assembly as claimed in claim 1 in which said front and rear thrust bearing members are threaded onto said shank so as to be held against rotation with respect thereto.

3. A mandrel assembly as claimed in claim 1 in which a first, axially open, annular, bearing ball groove is formed in said fourth surface of said bullet and a second, axially open, annular, bearing ball groove is formed in the front wall of said rear thrust bearing member, two sets of bearing balls respectively disposed in said grooves and rollingly engaging said rear surface of said front thrust bearing member and said third surface on said bullet, respectively, and including a cylindrical bushing sleeved on said shank between said front end of said rod and said head, said bullet and said front and rear thrust bearing members being sleeved on said bushing.

* * * * *